US011037492B2

(12) United States Patent
Shin et al.

(10) Patent No.: US 11,037,492 B2
(45) Date of Patent: Jun. 15, 2021

(54) DRIVER FOR DISPLAY DEVICE

(71) Applicant: Silicon Works Co., Ltd., Daejeon (KR)

(72) Inventors: Ju Young Shin, Daejeon (KR); Min Young Jeong, Daejeon (KR); Ho Sung Hong, Daejeon (KR); Jung Bae Yun, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/913,900

(22) Filed: Jun. 26, 2020

(65) Prior Publication Data

US 2021/0005136 A1 Jan. 7, 2021

(30) Foreign Application Priority Data

Jul. 1, 2019 (KR) ..... 10-2019-0078827

(51) Int. Cl.
*G09G 3/36* (2006.01)
*G09G 3/3225* (2016.01)

(52) U.S. Cl.
CPC ... *G09G 3/3225* (2013.01); *G09G 2300/0804* (2013.01); *G09G 2310/0297* (2013.01); *G09G 2330/06* (2013.01)

(58) Field of Classification Search
CPC ..... G09G 3/2003; G09G 3/3225; G09G 2300/0413; G09G 2310/0297; G09G 2320/0233; G09G 2320/0285; G09G 2330/06; G09G 2330/027
USPC ..... 345/76, 98, 100, 204
See application file for complete search history.

(56) References Cited

U.S. PATENT DOCUMENTS

2015/0379909 A1* 12/2015 Yu ..... G09G 3/3258 345/690
2016/0063914 A1* 3/2016 Lee ..... G09G 3/3648 345/211
2016/0163265 A1* 6/2016 Yang ..... G09G 3/3233 345/690
2018/0082639 A1* 3/2018 Shin ..... G09G 3/3275
2018/0151129 A1* 5/2018 Park ..... G09G 3/3291

FOREIGN PATENT DOCUMENTS

KR 20120038133 A2 4/2012
KR 101529005 B1 6/2015
KR 20190028057 A 3/2019
KR 20200008681 A 1/2020

* cited by examiner

*Primary Examiner* — Jennifer T Nguyen
(74) *Attorney, Agent, or Firm* — Polsinelli PC

(57) ABSTRACT

Disclosed is a driver for a display device, which is improved to stably sense pixels. The driver includes a multiplexer configured to output the sensing signal of a first input stage or second input stage, a first switch configured to switch a connection between an odd channel and the first input stage, a second switch configured to switch a connection between an even channel and the second input stage, and a switching circuit configured to switch a connection between a common power line and the first input stage or the second input stage.

13 Claims, 2 Drawing Sheets

DRIVER FOR DISPLAY DEVICE

BACKGROUND

1. Technical Field

The present disclosure relates to a driver for a display device, and more particularly, to a driver for a display device, which is improved to stably sense pixels.

2. Related Art

A display device may be configured by using a display panel using an active matrix organic light emitting diode (hereinafter referred to as an "AMOLED").

If a display panel using an AMOLED is used, a display device is configured to drive the pixels of the display panel in accordance with display data, sense characteristics of the pixels, and correct display data.

As an example, a driver for driving pixels in accordance with display data may be designed to include a circuit for sensing characteristics of the pixels.

In this case, the driver is configured to receive analog sensing signals obtained by sensing the pixels and to output digital sensing data corresponding to the sensing signals. Furthermore, a timing controller is configured to receive sensing data and correct display data based on the sensing data.

The driver includes an analog-to-digital converter (ADC) for receiving sensing signals through channels having a number (e.g., 2N wherein N is a natural number) corresponding to the pixels of one line.

The ADC samples and holds the sensing signals using an embedded sample & hold circuit, converts the sampled and held signals into sensing data, and outputs the sensing data.

The driver has a problem in that it is required to have many parts and a wide area in order to sample and hold the sensing signals of all of 2N channels.

Furthermore, the driver is configured to transmit, to the timing controller, sensing data for the sensing signals of all the 2N channels. Accordingly, there is a problem in that the amount of data transmitted between the driver and the timing controller is large.

In order to reduce the amount of data transmitted, the driver needs to be configured to alternately sense odd channels and even channels and to transmit a reduced amount of data corresponding to N odd channels or N even channels.

To this end, the driver may be configured to sense one of the odd channels and the even channels for sensing purposes. In this case, unsensed channels are floated.

The floated channels may have an effect on sensing operations of adjacent channels of the driver because they may cause interference (e.g., noise or coupling) with the adjacent channels.

Accordingly, in the sensing operation of the driver, it is difficult to obtain desired results due to the interference. Furthermore, if great interference occurs, a malfunction may occur in the sensing operation.

SUMMARY

Various embodiments are directed to the provision of a driver for a display device, which can reduce the number of parts and an area necessary to sample and hold the sensing signals of channels corresponding to the pixels of a display panel.

Also, various embodiments are directed to the provision of a driver for a display device, which can prevent sensing operations of channels, selected for sensing, from being influenced by interference of channels not selected for the sensing.

In an embodiment, a driver for a display device may include a multiplexer including a first input stage and a second input stage and configured to output a sensing signal of the first input stage or the second input stage, a first switch configured to switch a connection between a first channel and the first input stage, a second switch configured to switch a connection between a second channel and the second input stage, and a switching circuit configured to switch the connection of a common power line to the first input stage or the second input stage. When the first switch is turned on in order to sense a first pixel of a display panel through the first channel, the second switch is turned off and the common power line is electrically connected to the second input stage through the switching circuit. When the second switch is turned on in order to sense a second pixel of the display panel through the second channel, the first switch is turned off and the common power line is electrically connected to the first input stage through the switching circuit.

In an embodiment, a driver for a display device may include a multiplexer including a first input stage and a second input stage and configured to output a sensing signal of the first input stage or the second input stage, a first switch configured to switch a connection between a first channel and the first input stage, a second switch configured to switch a connection between a second channel and the second input stage, and a switching circuit configured to provide a constant voltage to one of the first input stage and the second input stage. When the first switch is turned on in order to sense a first pixel of a display panel through the first channel, the second switch is turned off and the constant voltage is applied to the second input stage through the switching circuit. When the second switch is turned on in order to sense a second pixel of the display panel through the second channel, the first switch is turned off and the constant voltage is applied to the first input stage through the switching circuit.

DETAILED DESCRIPTION

Figure 1:
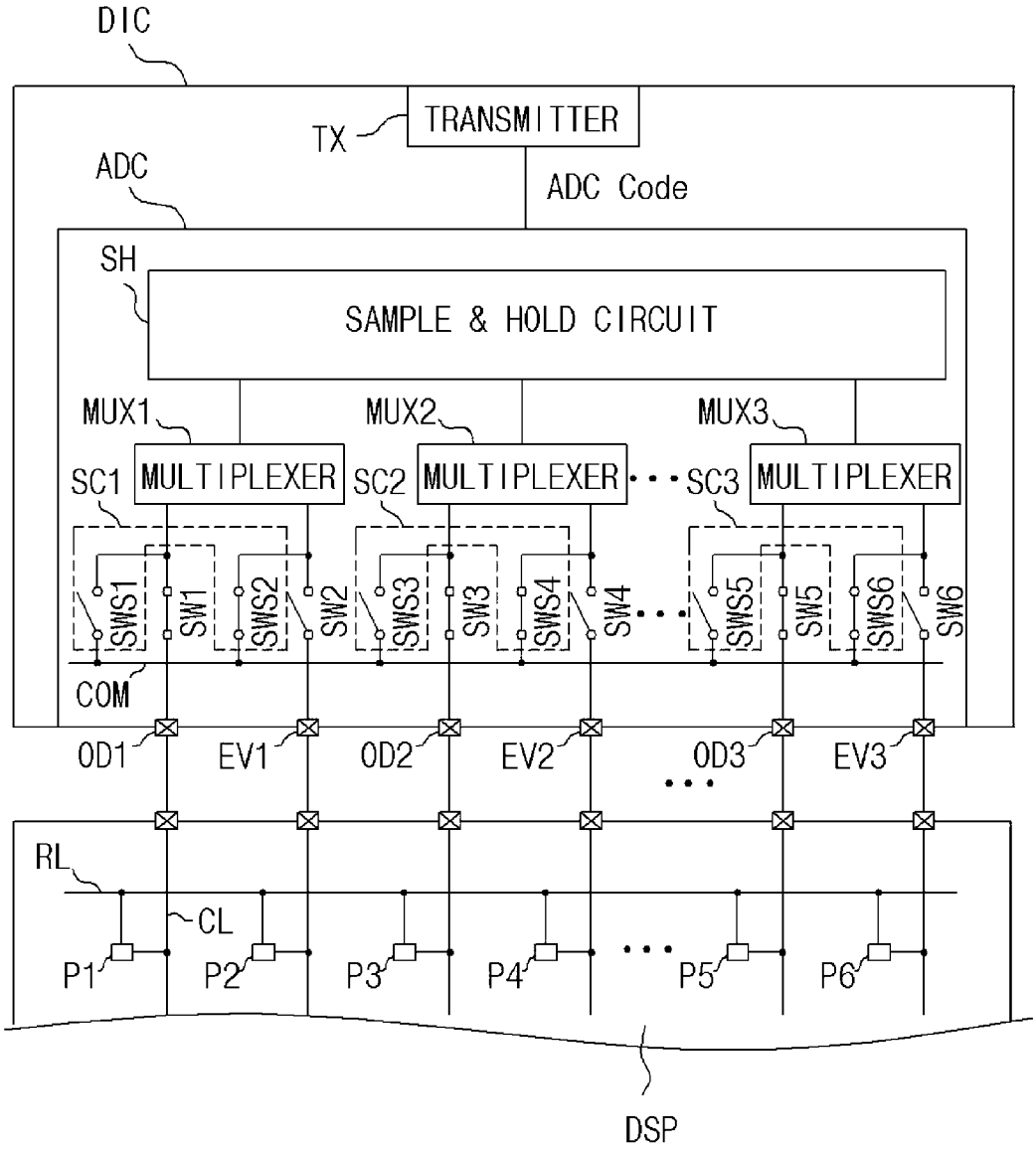
FIG. 1 is a circuit diagram illustrating an embodiment of a driver for a display device, and illustrates a case where odd channels have been selected for sampling & holding.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

FIG. 1 is to exemplify an embodiment and illustrates a driver DIC and display panel DSP configuring a display device.

The channels of the driver DIC are connected to the channels of the display panel DSP in a one-to-one way, and are configured to receive sensing signals.

The display panel DSP includes pixels P1 to P6 arranged in a row.

For a display of an image, the pixels P1 to P6 are turned on or off by a driving signal, and emit light in accordance with the gradation of a display signal. In this case, the driving signal has a waveform for turn-on in a line unit of a frame, and is provided through a row line RL. Furthermore, the display signal is an analog signal having a gradation corresponding to display data, and may be provided through a source line (not illustrated). In FIG. 1, an example of a configuration in which the display signal is output by the driver DIC and input to the display panel DSP and the pixels P1 to P6 is omitted.

Furthermore, characteristics of the pixels P1 to P6 are sensed through a column line CL configured as a sensing line. That is, sensing signals corresponding to characteristics of the pixels P1 to P6 are input from the display panel DSP to the respective channels of the driver DIC.

The driver DIC includes channels for receiving sensing signals. In an embodiment of the present disclosure, the number of channels of the driver DIC may be defined as 2N (N is a natural number). The 2N channels may be divided into N first channels and N second channels. The channels of the driver DIC are divided into odd channels OD1 to OD3 and even channels EV1 to EV3 depending on the sequence of the arranged channels. The odd channels correspond to the first channels, and the even channels correspond to the second channels. In FIG. 1, the number of channels is 6, the number of odd channels OD1 to OD3 is 3, and the number of even channels EV1 to EV3 is 3.

The odd channels OD1 to OD3 and the odd pixels P1, P3 and P5 of the display panel DSP are connected in a one-to-one way. Each of the odd channels OD1 to OD3 receives the sensing signal of a corresponding odd pixel. Furthermore, the even channels EV1 to EV3 and the even pixels P2, P4 and P6 of the display panel DSP are connected in a one-to-one way. Each of the even channels EV1 to EV3 receives the sensing signal of a corresponding even pixel. In the above description, the odd pixels may be understood as being first pixels corresponding to the first channels. The even pixels may be understood as being second pixels corresponding to the second channels.

The driver DIC is configured to include an analog-to-digital converter (ADC) and a transmitter TX. The ADC includes the odd channels OD1 to OD3 and the even channels EV1 to EV3. The ADC senses and converts analog sensing signals received through the odd channels OD1 to OD3 and the even channels EV1 to EV3, and outputs digital sensing data. The transmitter TX transmits sensing data (e.g., ADC code) of the ADC to an external controller (not illustrated).

The ADC is configured to include multiplexers MUX1 to MUX3, a sample & hold circuit SH and switches SW1 to SW6 and SWS1 to SWS6.

Among the switches SW1 to SW6 and SWS1 to SWS6, the switches SW1, SW3 and SW5 are connected to the odd channels OD1 to OD3 in a one-to-one way, and the switches SW2, SW4 and SW6 are connected to the even channels EV1 to EV3 in a one-to-one way. Furthermore, the switches SWS1 to SWS6 are connected to a common electrode COM. The driver DIC includes N multiplexers in accordance with 2N channels.

In this case, the common electrode COM illustrates an example of a common power line for reducing coupling capacitance and noise by preventing the floating of an unselected input stage of the multiplexers MUX1 to MUX3. The common power line may be configured to be connected in common to the plurality of switches. For example, the common power line may be configured using an electrode or power line to which a constant voltage, such as a ground voltage, is applied. In an embodiment of the present disclosure, the common power line is configured as the common electrode COM for convenience of a description.

Each of the multiplexers MUX1 to MUX3 is configured in accordance with an odd channel and even channel that are adjacent to each other to form a pair. Accordingly, the driver DIC includes N multiplexers in accordance with 2N channels.

First, the switches SW1, SW2, SWS1, and SWS2 are configured on the input side of the multiplexer MUX1. The switches SWS1 and SWS2 among the switches SW1, SW2, SWS1, and SWS2 are included in a switching circuit SC1.

The multiplexer MUX1 includes a first input stage and a second input stage. The first input stage is connected to the switch SW1 and the switch SWS1 of the switching circuit SC1. The second input stage is connected to the switch SW2 and the switch SWS2 of the switching circuit SC1.

In the above configuration, the switch SW1 switches a connection between the odd channel OD1 and the first input stage of the multiplexer MUX1. The switch SW2 switches a connection between the even channel EV1 and the second input stage of the multiplexer MUX1.

The switches SWS1 and SWS2 of the switching circuit SC1 are configured to switch connections between the common electrode COM and the first input stage or second input stage of the multiplexer MUX1. That is, the switches SWS1 and SWS2 of the switching circuit SC1 are configured to switch the application of a constant voltage to the first input stage or second input stage of the multiplexer MUX1.

More specifically, the switch SWS1 switches a connection between the common electrode COM and the first input stage of the multiplexer MUX1. The switch SWS2 switches a connection between the common electrode COM and the second input stage of the multiplexer MUX1. That is, the switch SWS1 switches the application of a constant voltage from the common electrode COM to the first input stage of the multiplexer MUX1. The switch SWS2 switches the application of a constant voltage from the common electrode COM to the second input stage of the multiplexer MUX1.

When the multiplexer MUX1 selects the reception of the sensing signal of the odd channel OD1 through the first input stage, the switch SW1 is turned on, and the switch SWS1 is turned off. In response thereto, the switch SW2 is turned off, and the switch SWS2 is turned on. In accordance with the turn-on or turn-off state of the switches SW1, SW2, SWS1, and SWS2, the sensing signal of the odd channel OD1 is input to the first input stage of the multiplexer MUX1, and the constant voltage of the common electrode COM is input to the second input stage of the multiplexer MUX1.

When the multiplexer MUX1 selects the reception of the sensing signal of the even channel EV1 through the second input stage, the switch SW2 is turned on, and the switch SWS2 is turned off. In response thereto, the switch SW1 is turned off, and the switch SWS1 is turned on. In accordance with the turn-on or turn-off state of the switches SW1, SW2, SWS1, and SWS2, the sensing signal of the even channel EV1 is input to the second input stage of the multiplexer MUX1, and the constant voltage of the common electrode COM is input to the first input stage of the multiplexer MUX1.

Since coupling between the remaining multiplexers MUX2 and MUX3 and the switches SW3 to SW6 and SWS3 to SWS6 is also the same as the coupling between the multiplexer MUX1 and the switches SW1, SW2, SWS1, and SWS2, a redundant description thereof is omitted.

As a result, the N switches SW1, SW3 and SW5 connected to the N odd channels are connected to the first input stages of the N multiplexers MUX1 to MUX3 in a one-to-one way. The N switches SW2, SW4 and SW6 connected to the N even channels are connected the second input stages of the N multiplexers MUX1 to MUX3 in a one-to-one way. Furthermore, the N switches SWS1, SWS3 and SWS5 connected to the common electrode COM are connected to the first input stages of the N multiplexers MUX1 to MUX3 in a one-to-one way. The N switches SWS2, SWS4 and SWS6 connected to the common electrode COM are connected to the second input stages of the N multiplexers MUX1 to MUX3 in a one-to-one way.

In the above configuration, the multiplexers MUX1 to MUX3 are configured to alternately select the sensing signals of the odd pixels P1, P3 and P5, sensed through the odd channels OD1 to OD3, and the sensing signals of the even pixels P2, P4 and P6 sensed through the even channels EV1 to EV3 and to output the selected sensing signals to the sample & hold circuit SH.

The sample & hold circuit SH is configured to periodically alternately receive the sensing signals of the odd pixels P1, P3 and P5 and the sensing signals of the even pixels P2, P4 and P6 through the multiplexers MUX1 to MUX3 and to perform sampling and holding on the received sensing signals. To this end, the sample & hold circuit SH includes N sample & hold channels in accordance with the 2N channels of the driver DIC.

In this case, the sample & hold circuit SH is configured to sample and hold the N sensing signals of the odd pixels P1, P3 and P5 or the N sensing signals of the even pixels P2, P4 and P6 for each cycle. That is, the sample & hold circuit SH according to an embodiment can have a simple configuration compared to a case where a sample & hold circuit is configured to sample & hold the sensing signals of all channels, that is, the 2N sensing signals, for each cycle.

The ADC is configured to convert, into digital sensing data (e.g., ADC code), signals sampled and held by the sample & hold circuit SH and to output the sensing data (e.g., ADC code) to the transmitter TX.

Figure 2:
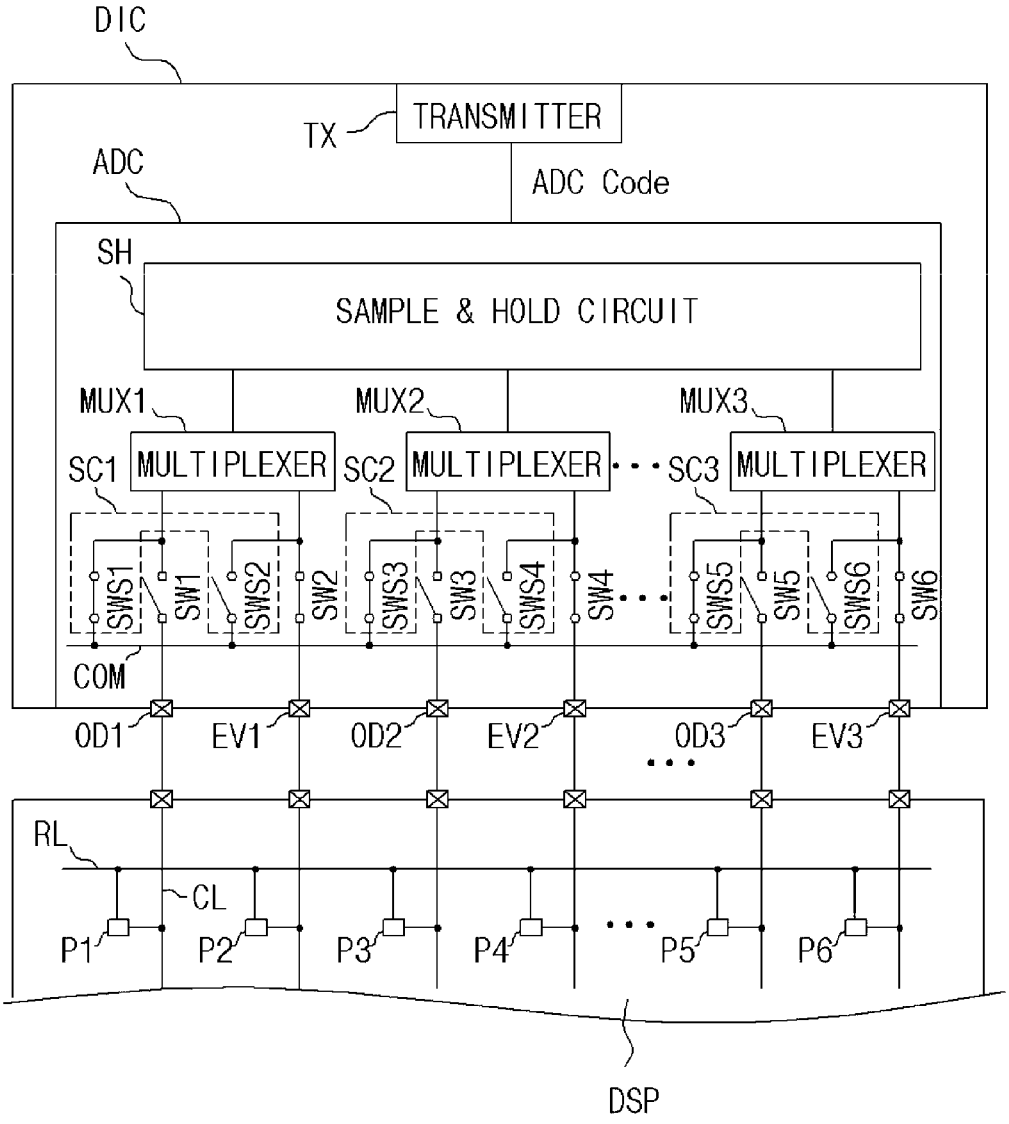
FIG. 2 illustrates a case where even channels have been selected for sampling & holding according to an embodiment.

The embodiment of FIG. 1 illustrates that the switches SW1 to SW6 and SWS1 to SWS6 have been switched to receive the sensing signals of the odd channels OD1, OD2 and OD3. The embodiment of FIG. 2 illustrates that the switches SW1 to SW6 and SWS1 to SWS6 have been switched to receive the sensing signals of the even channels EV1, EV2 and EV3. Since the switches SW1 to SW6 and SWS1 to SWS6 in FIGS. 1 and 2 have the same configuration except the switching states of the switches SW1 to SW6 and SWS1 to SWS6, a redundant description thereof is omitted.

In this case, the sensing signal may be differently understood depending on a sensing method of the sample & hold circuit SH. If the sample & hold circuit SH senses a current, the sensing signal may be understood as a current. In contrast, if the sample & hold circuit SH senses a voltage, the sensing signal may be understood as a voltage.

In the above configuration, as in FIG. 1, when the sensing signals of the odd channels OD1 to OD3 are applied to the first input stages of the multiplexers MUX1 to MUX3 by the turn-on of the switches SW1, SW3 and SW5, the sensing lines between the second input stages of the multiplexers MUX1 to MUX3 and the switches SW2, SW4 and SW6 are connected to the common electrode COM by the turn-on of the switches SWS2, SWS4 and SWS6. At this time, the switches SWS1, SWS3 and SWS5 are in a turn-off state.

That is, the sensing lines between the second input stages of the multiplexers MUX1 to MUX3 and the switches SW2, SW4 and SW6 are stabilized as the constant voltage of the common electrode COM is applied to the sensing lines. As a result, the sensing lines between the first input stages of the multiplexers MUX1 to MUX3 and the switches SW1, SW3 and SW5 can transmit the sensing signals of the odd channels OD1, OD2 and OD3 without interference, such as noise or coupling attributable to adjacent channels.

In contrast, as in FIG. 2, when the sensing signals of the even channels EV1 to EV3 are applied to the second input stages of the multiplexers MUX1 to MUX3 by the turn-on of the switches SW2, SW4 and SW6, the sensing lines between the first input stages of the multiplexers MUX1 to MUX3*s* and the switches SW1, SW3 and SW5 are connected to the common electrode COM by the turn-on of the switches SWS1, SWS3 and SWS5. At this time, the switches SWS2, SWS4 and SWS6 are in a turn-off state.

That is, the sensing lines between the first input stages of the multiplexers MUX1 to MUX3*s* and the switches SW1, SW3 and SW5 are stabilized as the constant voltage of the common electrode COM is applied to the sensing lines. As a result, the sensing lines between the second input stages of the multiplexers MUX1 to MUX3 and the switches SW2, SW4 and SW6 can transmit the sensing signals of the even channels EV1, EV2 and EV3 without interference, such as noise or coupling attributable to adjacent channels.

Accordingly, the present disclosure can reduce, to N, the number of channels for sampling and holding the sensing signals of 2N channels corresponding to the pixels of the display panel, and thus can reduce the number of wires and simplify the configuration of the sample & hold circuit.

Accordingly, it is possible to reduce the number of parts and an area necessary to sample and hold the sensing signals of the driver of the display panel according to an embodiment.

Furthermore, the present disclosure can electrically stabilize channels not selected to receive sensing signals in the driver for a display device, thereby preventing channels, selected to receive sensing signals, from being influenced by interference of adjacent channels.

The present disclosure has effects in that it can reduce the number of parts and an area necessary to sample and hold the sensing signals in the driver for a display device by reducing, to N, the number of channels for sampling and holding the sensing signals of 2N channels corresponding to the pixels of the display panel, thus reducing the number of wires and simplifying the configuration of the sample & hold circuit.

Furthermore, the present disclosure has an effect in that it can connect the unselected channels to the common power line in the driver for a display device, thereby preventing the sensing operations of selected channels from being influenced by interference of unselected channels.

Furthermore, the present disclosure has an effect in that it can prevent the sensing operations of selected channels from being influenced by interference of unselected channels by applying a constant voltage to the unselected channels in the driver for a display device.

While various embodiments have been described above, it will be understood to those skilled in the art that the embodiments described are by way of example only.

Accordingly, the disclosure described herein should not be limited based on the described embodiments.

What is claimed is:

1. A driver for a display device comprising:

a multiplexer comprising a first input stage and a second input stage and configured to output a sensing signal of the first input stage or the second input stage;

a first switch configured to switch a connection between a first channel and the first input stage;

a second switch configured to switch a connection between a second channel and the second input stage; and a switching circuit configured to switch a connection of a common power line to the first input stage or the second input stage, wherein when the first switch is turned on in order to sense a first pixel of a display panel through the first channel, the second switch is turned off and the common power line is electrically connected to the second input stage through the switching circuit, and when the second switch is turned on in order to sense a second pixel of the display panel through the second channel, the first switch is turned off and the common power line is electrically connected to the first input stage through the switching circuit.

2. The driver of claim 1, wherein the switching circuit comprises:

a third switch configured to switch the connection between the first input stage and the common power line; and a fourth switch configured to switch the connection between the second input stage and the common power line, a switching state of the third switch is opposite to a switching state of the first switch, and a switching state of the fourth switch is opposite to a switching state of the second switch.

3. The driver of claim 1, further comprising a sample & hold circuit configured to perform sampling and holding on the sensing signal, wherein the multiplexer is configured to alternately select the sensing signal of the first pixel sensed through the first channel and the sensing signal of the second pixel sensed through the second channel and to output the selected sensing signal to the sample & hold circuit.

4. The driver of claim 1, wherein the common power line comprises a power line to which a constant voltage is applied.

5. The driver of claim 1, wherein the common power line comprises a common electrode to which a ground voltage is applied.

6. The driver of claim 1, wherein:

the first channel is an odd channel, the second channel is an even channel, the first pixel is an odd pixel, and the second pixel is an even pixel.

7. The driver of claim 1, wherein:

the N first switches, the N second switches and the N multiplexers are configured in accordance with the 2N channels comprising the N first channels and the N second channels, with respect to each of the N multiplexers, one first switch is connected to the first input stage, one second switch is connected to the second input stage, and the common power line is connected to the first input stage or the second input stage by the switching circuit, and the N is a natural number.

8. A driver for a display device comprising:

a multiplexer comprising a first input stage and a second input stage and configured to output a sensing signal of the first input stage or the second input stage;

a first switch configured to switch a connection between a first channel and the first input stage;

a second switch configured to switch a connection between a second channel and the second input stage; and a switching circuit configured to provide a constant voltage to one of the first input stage and the second input stage, wherein when the first switch is turned on in order to sense a first pixel of a display panel through the first channel, the second switch is turned off and the constant voltage is applied to the second input stage through the switching circuit, and when the second switch is turned on in order to sense a second pixel of the display panel through the second channel, the first switch is turned off and the constant voltage is applied to the first input stage through the switching circuit.

9. The driver of claim 8, wherein the switching circuit comprises:

a third switch configured to switch the application of the constant voltage to the first input stage; and a fourth switch configured to switch the application of the constant voltage to the second input stage, a switching state of the third switch is opposite to a switching state of the first switch, and a switching state of the fourth switch is opposite to a switching state of the second switch.

10. The driver of claim 8, further comprising a sample & hold circuit configured to perform sampling and holding on the sensing signal, wherein the multiplexer is configured to alternately select the sensing signal of the first pixel sensed through the first channel and the sensing signal of the second pixel sensed through the second channel and to output the selected sensing signal to the sample & hold circuit.

11. The driver of claim 8, wherein a ground voltage is applied as the constant voltage.

12. The driver of claim 8, wherein:

the first channel is an odd channel, the second channel is an even channel, the first pixel is an odd pixel, and the second pixel is an even pixel.

13. The driver of claim 8, wherein:

the N first switches, the N second switches and the N multiplexers are configured in accordance with the 2N channels comprising the N first channels and the N second channels, with respect to each of the N multiplexers, one first switch is connected to the first input stage, one second switch is connected to the second input stage, and the constant voltage is applied to the first input stage or the second input stage by the switching circuit, and the N is a natural number.

* * * * *